United States Patent [19]

Ishida

[11] 4,256,995

[45] Mar. 17, 1981

[54] ELECTRONIC PRE-EMISSION FLASH DEVICE

[75] Inventor: Tokuji Ishida, Daito, Japan

[73] Assignee: Minolta Camera Kabushiki Kaisha, Osaka, Japan

[21] Appl. No.: 21,830

[22] Filed: Mar. 19, 1979

[30] Foreign Application Priority Data

Mar. 29, 1978 [JP] Japan ..... 53-36976

[51] Int. Cl.[3] ..... H05B 41/34

[52] U.S. Cl. ..... 315/241 P; 315/151; 315/158; 354/25; 354/33

[58] Field of Search ..... 315/151, 158, 241 P; 354/25, 33, 60 F, 128, 139, 145

[56] References Cited

U.S. PATENT DOCUMENTS

| | | | |
|---|---|---|---|
| 3,681,649 | 8/1972 | Uno et al. | 315/151 |
| 3,846,811 | 11/1974 | Nakamura et al. | 354/145 |

*Primary Examiner*—Eugene R. LaRoche
*Attorney, Agent, or Firm*—Watson, Cole, Grindle & Watson

[57] ABSTRACT

An electronic flash device capable of emitting a flash light of a regulated level over a considerable duration of time, prior to flash firing for emitting a torrent of flash light for flash photography. The device is provided with two capacitors, one of which is discharged through the flash tube and a current regulation circuit upon actuation of a first trigger switch, and the other of which, for example in relation to shutter release operation, is discharged through the flash tube without regulation of the discharge current upon subsequent actuation of a second trigger switch in relation to shutter opening. The pre-emission of flash light may be used for automatic focusing, automatic diaphragm determination and automatic flash control.

8 Claims, 3 Drawing Figures

ELECTRONIC PRE-EMISSION FLASH DEVICE

BACKGROUND OF THE INVENTION

1. Field of the Invention

The present invention relates to an electronic flash device for use on a camera for flash photography, and more particularly it relates to an improved type of electronic flash device capable of pre-emission of flash light before a flash exposure is effected.

2. Description of the Prior Art

There have been proposed exposure control systems wherein in flash photography, an electronic flash tube is fired immediately before a film exposure and the light reflected from an object being illuminated is measured. The measured value is stored to control the amount of light to be emitted from the same or another electronic flash tube at the time of actual exposure. Flash devices used in such exposure control systems have relatively short flash times of one to two milli-seconds for both pre-emission of light and flash exposure. Such flash time for pre-emission light is too short if the pre-emission light is to be used for light measurement values for automatic diaphragm aperture control, or used for detecting a camera-to-object distance for automatic focus control of a camera objective.

U.S. Pat. No. 3,846,811 discloses circuitry for obtaining constant flash light output during normal flash photography. There is no suggestion in the reference to utilize such circuitry for pre-emission flash light.

SUMMARY OF THE INVENTION

It is therefore a primary object of the present invention to provide an improved electronic flash device which permits auxiliary pre-emission of flash light with a given light intensity over a comparatively long period of time, and also ensuring normal mode of flash firing upon camera exposure. According to the present invention, if the pre-emission is used for automatic focus adjustment, such automatic focus adjustment can be made even in the dark at night. In addition, the pre-emission flash light device according to the present invention may be effective for use in a camera which requires a longer period of the pre-emission flash time than an ordinary flash device for collecting information of an object to be photographed, or for controlling a diaphragm aperture based on the collected information.

The electronic flash device of the present invention is capable of pre-emitting a given intensity of light over a comparatively long period of time, as well as providing illumination in a regular mode for flash photography, ensuring adequate flash time for light measurement and range finding by utilizing auxiliary pre-emission of light. The flash device makes possible, for example, automatic focus adjustment in the dark, or automatic diaphragm aperture control. Furthermore, it allows light measurement and storage of the measured value to be performed through the auxiliary pre-emission of light over a sufficiently long period of time for automatic exposure time control and automatic flash control.

DETAILED DESCRIPTION OF THE PREFERRED EMBODIMENT

Figure 1:
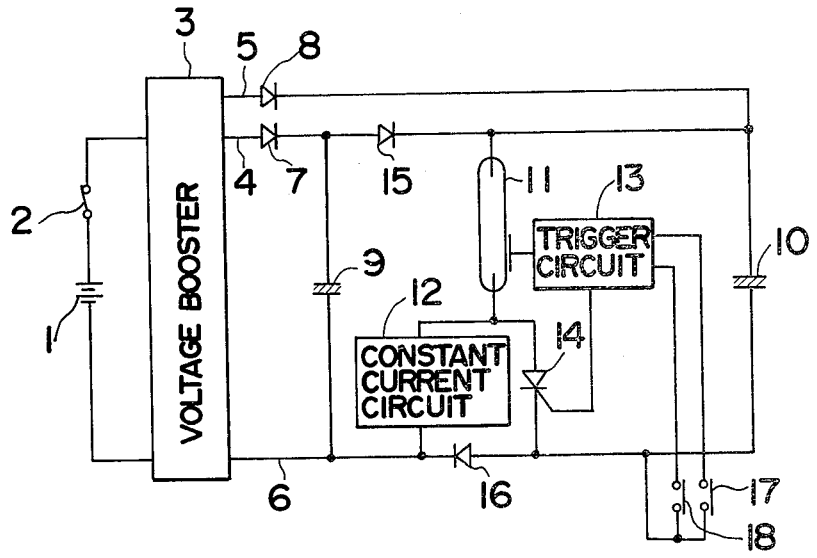
FIG. 1 is a circuit diagram schematically illustrating an embodiment of the present invention.

Referring now to FIG. 1 which shows a circuit diagram of a flash lamp device according to one embodiment of the present invention, the series connection of power battery 1 and power switch 2 is connected across booster circuit 3 which in turn includes an oscillation circuit for providing high voltages at outputs 4 and 5. Produced from terminals 4 and 5 are AC voltages of, for example 100 V and 300 V respectively, relative to ground line 6 so that capacitors 9 and 10 are respectively charged to the voltages through rectifier diodes 7 and 8. Flash tube 11 is connected at one terminal to both capacitors 9 and 10, and at the other terminal to ground line 6 through constant current circuit 12. Thyristor 14 is connected to flash tube trigger circuit 13 and to ground line 6 respectively through switches 17 and 18 for auxiliary light pre-emission start and flash exposure start. Switches 17 and 18 may be provided in a camera body. Diode 15 connected between capacitor 9 and flash tube 11 serves to prevent current flow from capacitor 10 to capacitor 9. Diode 16 is connected between constant current circuit 12 and thyristor 14 to interrupt discharge of capacitor 10 through the constant current circuit when only the latter is conductive.

Switch 17 is closed, for example, in response to the camera shutter release operation, and switch 18 is closed in response to the so-called synchronizing signal which is produced when the camera shutter is opened. Furthermore, when the present invention is employed in an electronic flash device of the independent or separate type (i.e. of the type not built-in or incorporated in a camera), switch 17 may be adapted to be closed manually. Additionally, both switches 17 and 18 may be replaced by semiconductor switch elements which turn on in relation to the sequential control of the camera operation.

Figure 2:
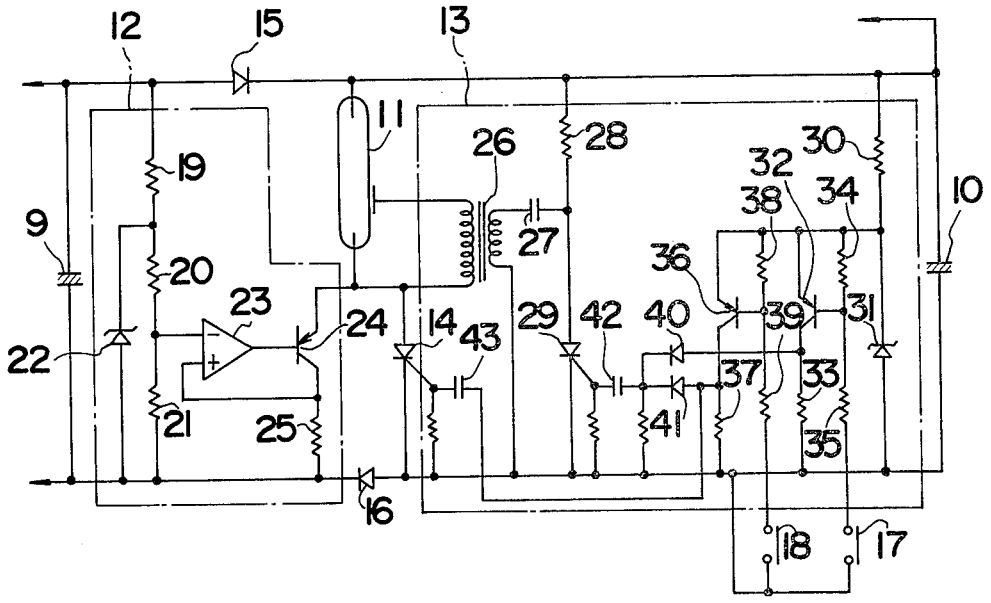
FIG. 2 is a circuit diagram showing detailed constructions of circuits 12 and 13 of FIG. 1.

With reference to FIG. 2, constant current circuit 12 comprises resistors 19, 20 and 21 serially connected across capacitor 9, Zener diode 22 in parallel connection with the serially connected resistors 20 and 21, operational amplifier 23 having one input terminal connected to the node of the series-connected circuit (i.e. between resistors 20 and 21), current control transistor 24, and resistor 25 connected serially thereto. With flash tube 11 triggered, a current flows therethrough via transistor 24 and resistor 25. A voltage across resistor 25 produced by the current running therethrough is applied to one of the inputs of operational amplifier 23. Applied to the other input of operational amplifier 23 is a portion of a constant voltage produced by Zener diode 22 divided by resistors 20 and 21. Thus, transistor 24 is controlled so that its collector potential remains constant, whereby a fixed intensity of light is emitted from the flash tube when it is energized through transistor 24 by capacitor 9.

Flash trigger circuit 13 in FIG. 2 includes well known circuitry comprising trigger transformer 26, trigger capacitor 27 and resistor 28, as well as elements to be described below.

Serially connected resistor 30 and Zener diode 31 are connected across main capacitor 10 to serve as a constant voltage source. A fixed resistor may be used for Zener diode 31. A circuit comprising transistor 32, resistors 33, 34 and 35 generates a trigger pulse for turning on thyristor 29 in response to the closure of switch 17. Furthermore, transistor 36 and resistors 37, 38 and 39 form a circuit for generating a trigger pulse to turn on thyristors 14 and 29 upon closure of switch 18. When switch 17 is closed for pre-emission of flash light, transistor 32 is turned on and its collector potential increases to a high level, with the change in potential being transmitted through diode 40 and capacitor 42 to the gate of thyristor 29, which is also turned on. However, the trigger pulse generated when transistor 32 is turned on is not transmitted to the gate of thyristor 14 due to the action of diode 41, thereby permitting thyristor 14 to remain turned off.

When switch 18 is then closed for flash exposure, transistor 36 is turned on and its output is transmitted through diode 41 and capacitor 42 to the gate of thyristor 29, and at the same time, through capacitor 43 to the gate of thyristor 14, whereby both thyristors 14 and 29 are turned on. Thus, the charge of capacitor 10 is discharged through thyristor 29.

It should be understood that thyristor 14 may be turned off during the discharge of capacitor 10 by using a well-known flash tube control device to stop flash firing. Also, transistor 24 may be controlled by monitoring the light from the flash tube by means of a photocell directly receiving the flash light for ensuring a fixed intensity of light during auxiliary pre-emission of flash light.

With power switch 2 closed, an oscillation circuit included in booster circuit 3 operates to produce AC voltages between terminals 4 and 6, and between terminals 5 and 6. These AC voltages are rectified by diodes 7 and 8, into DC voltages, e.g. of 100 V and 300 V, and capacitors 9 and 10 are charged with these voltages, respectively. When switch 17 is closed after completion of charging of capacitors 9 and 10, thyristor 29 is turned on to discharge trigger capacitor 27, as described above, causing flash tube 11 to be triggered. At this time, thyristor 14 remains off. Thus, the charge of capacitor 9 is first discharged through diode 15, flash tube 11 and constant current circuit 12. During discharge, the discharge current flow is maintained at a fixed value through the action of constant current circuit 12 for a given period of time commensurate with the flash tube characteristics, charged energy and discharge current of capacitor 9. Thus, a fixed intensity of light is emitted from flash tube 11 for a given period of time. As an example of numerical values, the capacity of capacitor 9 is assumed to be 1000 $\mu$F, to which 100 V is charged to discharge a 2 A constant current with a flash tube terminal voltage of 50 V, and this will result in the emission of a fixed light intensity for approximately 25 m seconds. It is to be noted that a sufficient resistance value of resistor 28 is used, to permit thyristor 29 to turn off right after the discharge of trigger capacitor 27 to re-charge trigger capacitor 27.

Figure 3:
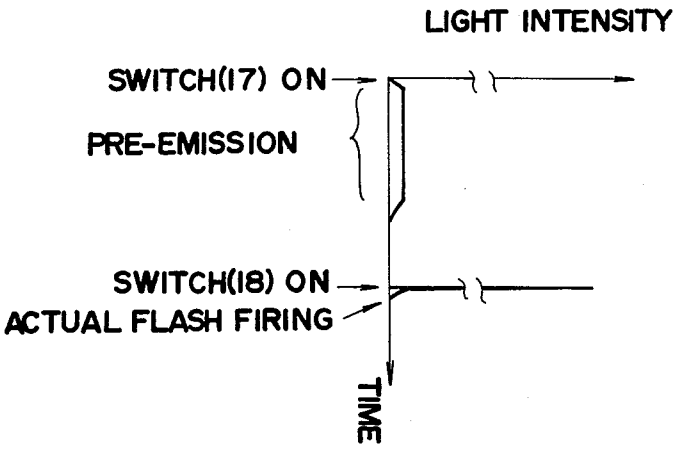
FIG. 3 is a graph showing the light emission characteristic of the flash lamp according to the present embodiment.

When switch 18 is then closed, flash tube 11 and thyristor 14 are triggered to discharge capacitor 10 through flash tube 11 and thyristor 14, whereby flash tube 11 emits a flash. The above light emitting mode is illustrated in FIG. 3.

What is claimed is:

1. An electronic flash device comprising: an electronic flash tube; a first energizing means for energizing said flash tube with a regulated current; a second energizing means for energizing said flash tube with non-regulated electric current, a switch means for actuating said second energizing means, a first trigger circuit for triggering said flash tube with said switch means deactuated so that said flash tube may be energized by said first energizing means, and a second trigger circuit for triggering said flash tube and actuating said switch means subsequent to the triggering of said flash tube by said first trigger circuit.

2. An electronic flash device as in claim 1 wherein said first energizing means includes a first capacitor for storing electric energy to be supplied to said flash tube, and means for regulating the current through said flash tube independently of exposure conditions.

3. An electronic flash tube as in claim 2 wherein said second energizing means includes a second capacitor for storing electric energy to be supplied to said flash tube, and said first and second energizing means are connected substantially in parallel with one another to said flash tube.

4. An electronic flash tube as in claim 2 wherein said means for regulating includes current regulation means and means for feeding back information of the electric current flowing through said current regulation means.

5. An electronic flash device as in claim 3 wherein said switch means includes a semiconductor switching element serially connected between said flash tube and said second capacitor, and said first and second energizing means are arranged substantially in parallel with each other.

6. An electronic flash device comprising: an electronic flash tube; a first circuit loop including said flash tube, a first capacitor and means for regulating the current flowing through said first circuit loop; a second circuit loop including said flash tube, a second capacitor and an electronic switch element; and trigger means for firing said flash tube at first through said first circuit loop and subsequently through said second circuit loop.

7. An electronic flash device as in claim 6 wherein said trigger means includes a trigger circuit for applying a trigger signal to said flash tube, first actuation means for actuating said trigger circuit and said means for regulating, second actuation means for actuating said trigger circuit and said switch element, and means for preventing interference between said first and second actuation means.

8. An electronic flash device as in claim 7 wherein said trigger circuit includes a trigger capacitor and means for charging said trigger capacitor right after the flash tube triggering through said first circuit loop for the preparation for the next flash tube triggering through said second circuit loop.

* * * * *